US005372198A

United States Patent [19]

North et al.

[11] Patent Number: 5,372,198

[45] Date of Patent: Dec. 13, 1994

[54] ABANDONMENT OF SUB-SEA WELLS

[75] Inventors: John C. North, Port Elphinstone, Scotland; David O. Nelson, Duncan, Okla.; Colin S. Headworth, Aberdeen, Scotland

[73] Assignee: Halliburton Company, Duncan, Okla.

[21] Appl. No.: 102,432

[22] Filed: Aug. 5, 1993

[30] Foreign Application Priority Data

Feb. 11, 1993 [GB] United Kingdom ..... 9302701.9

[51] Int. Cl.[5] ..... E21B 43/11

[52] U.S. Cl. ..... 166/363; 166/365

[58] Field of Search ..... 166/365, 363, 285, 297, 166/335

[56] References Cited

U.S. PATENT DOCUMENTS 4,688,640 8/1987 Pritchard, Jr. ..... 166/365

*Primary Examiner*—William P. Neuder

*Attorney, Agent, or Firm*—Stephen R. Christian; C. P. Wain

[57] ABSTRACT

A cased suspended sub-sea well is secured for abandonment by setting a packer in the casing thereof, the packer having a perforating gun suspended therefrom firing the gun to perforate the casing and then injecting cement into the annulus behind the casing. The well is thus sealed and the casing above the packer can then be cut away

10 Claims, 4 Drawing Sheets

ABANDONMENT OF SUB-SEA WELLS

This invention relates to securing a suspended sub-sea well for abandonment.

It is common practice to effect temporary abandonment of sub-sea wells by squeeze cementing the perforated regions adjacent formations, placing cement plugs in the borehole and providing a corrosion cap over the wellhead. Wells which have been temporarily abandoned in this way can be re-activated by removal of the cap, drilling out the plugs and re-perforating, or side tracking the well. These temporarily abandoned wells have a wellhead (with cap) which is upstanding from the mudline by from 10 to 20 feet and, when permanent abandonment is to be effected, this upstanding portion is usually removed by severing the casing(s) at some 15 feet below the mud line.

The upper regions of a sub-sea well normally comprise several concentric casings, defining annuli therebetween, the casings extending from the well head to different depths within the well. In their lower regions, the casings define annuli with the wall of the borehole. At the wellhead, the annuli are sealed at the casing hangers. When, however, the well is permanently abandoned, the casings are severed below these seals and are thus opened. Whilst, during drilling of the well, regions of the annuli between a casing and the borehole wall will have been filled with cement, the fill may not have been complete or wholly satisfactory so that, when the casing hanger seals are removed at the top of the annuli, there is a risk of leakage of formation fluids (both gases and liquids) therefrom.

Conventionally, this is dealt with at well abandonment by cutting into the casings and filling the annuli with cement to seal the upper regions of the annuli. To achieve this, it is usual to use a semi-submersible drilling vessel (SSDV) which is located above the well and anchored in position. After removal of the cap from the well, a unit including blow-out preventers and a riser is lowered and locked on to the well head. A tool string is run on pipe to sever or perforate the casing or casings. Weighted fluid is pumped into the well to provide a hydrostatic head to balance any possible pressure release when the casing is cut. The casing is then cut, and the annulus cemented. The cemented annulus is then pressure tested to ensure an adequate seal has been obtained. The casing is severed below the mud line and the casing hangers retrieved, and finally after removal from the well, the well is filled with cement.

Whilst by this procedure satisfactory well abandonment can be achieved, it is expensive in terms of the equipment involved and the time taken which is often from 7 to 10 days per well. We have now devised a simpler and more economic way of effecting permanent abandonment of a suspended sub-sea well.

According to one aspect of the present invention, there is provided a method of securing a sub-sea well for abandonment, which comprises setting a packer in the casing in the well, the packer having a perforating system suspended therefrom; activating the perforating system to perforate the casing: pumping cement through the perforations into the annulus behind the casing; and preferably severing the casing above the set packer but below the mud line and removing the revered casing (including wellhead) well.

The method of the present invention does not require the use of an SSDV but rather can be carried out from a diving support vessel. The whole procedure can be completed much more quickly than the conventional process described above. In accordance with the present invention, a well can be secured and permanently abandoned in an environmentally safe condition in less than three days.

In the method of the present invention, pressure control of the well is achieved using a packer. There are various suitable packers for this purpose as will be clear to those skilled in the art. We prefer to use an 0TIS hydraulic set packer, but other types of packer can be used. For example, explosive set packers can be employed. Positioned below the packer is a perforating system, eg a perforating gun, the purpose of which is to perforate the casing to allow access to the annulus behind the casing. We prefer to use a hydraulically fired perforating gun, such as an HRS TCP perforating gun, but other types can be used.

The packer with suspended perforating system, eg gun, is run into the well in any suitable manner, such as on stinger tubing or on other rigid or flexible means. A valved cement supply line is provided in order to pump cement into the annulus after perforation of the casing. The stinger can conveniently have hydraulic control lines attached thereto for control of the gun, packer setting and other functions.

Where there is more than one annul us to seal, the method of the invention can be repeated so that in the first run the innermost annulus is cemented, then in the second run the next annulus is cemented, and so on. The packer and suspended gun used for the first run remain in the well, and a second packer and gun are set above the first in order to carry out the second run. It is possible in the second run to use perforating gun charges which will cause simultaneous perforation of the innermost two casings to allow access to the second annulus. However, in the alternative, the innermost casing can be severed first, and then the second casing can be perforated through the pre-formed cut in the inner casing. After the second run, the second packer/gun remains in the well (like the first packer/gun).

When the, or each of the, annuli as necessary have been sealed by cementing (and the seals tested), the well head is usually removed after severing the casing(s) below the mud line, usually about 15 feet below the mud line. The well is then preferably filled with cement to finish the abandonment.

Preferably, in the method of the invention, the tool used to run the packer/perforating apparatus into the well is severed from the apparatus; so as to allow removal of the tool whilst leaving the apparatus in the well.

Preferably, in the method of the invention, the casing is used before attempting to set the packer in order to reduce any risk of premature or otherwise unsatisfactory setting.

According to a second aspect of the invention, there is provided a system for securing a sub-sea well for abandonment, which comprises a diving support vessel, a packer and perforating system for location in the well, cement supply means, and means for severing the casing below the mudline and removal of the wellhead from the well.

In order that the invention may be more fully understood, embodiments thereof will now be described, by way of example only, with reference to the accompanying drawings which are all schematic vertical sectional views of the upper region of a subsea well:

Figure 2:
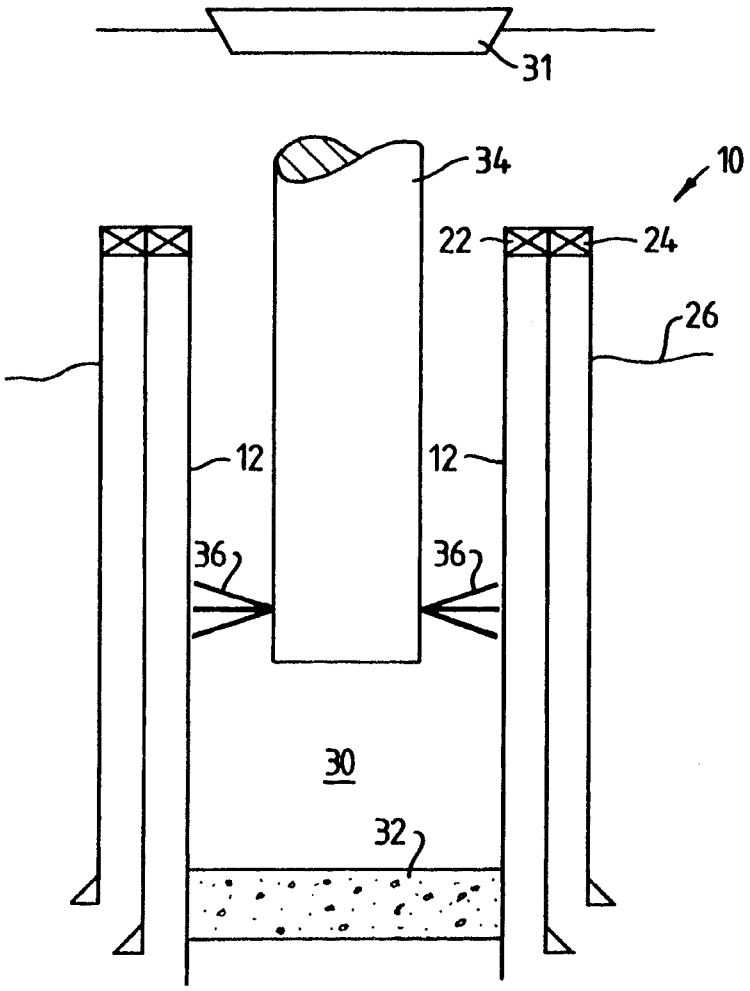
FIG. 2 shows cleaning of the casing.

Referring to the drawings (in all of which like numerals indicate like parts), there is shown a sub-sea well 10 which has been temporarily abandoned. The well has three concentric casings 12,14 and 16 defining therebetween two annuli 18,20, The casings are dependent from casing hangers (not shown) which provide annuli seals 22,24. The wellhead which is upstanding from the mud line (i.e. sea bottom) 26 is closed by a corrosion-resistant cap 28. The well bore 30 includes a cement plug 32.

In FIG. 2, a diving support vessel 31 has been brought over the well 10. FIG. 2 shows the well of FIG. 1 after removal of the corrosion cap 28 and insertion of a cleaning tool 34 into the bore 30. Tool 34 is to effect cleaning of the inner surface of casing 12. The tool may comprise high pressure jets, scrapers or other means 36 for removing debris as will be clear to those skilled in the art.

Figure 3:
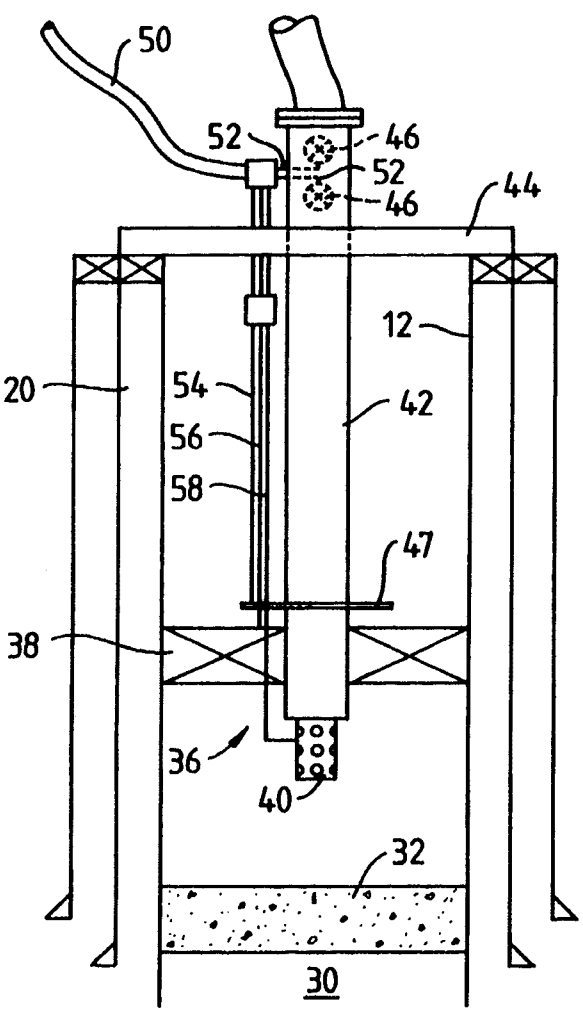
FIG. 3 shows a packer/perforating gun run into the casing.

FIG. 3 shows the well of FIG. 2 after removal of the cleaning tool 34, and insertion of a packer/gun tool 36. The tool 36 comprises a packer 38 (which is illustrated after setting to seal against casing 12) and a perforating gun 40 suspended therefrom. The tool 36 is mounted on a supply tube 42 extending out of the well. A locating plate 44 or the like is located over the open top of the well bore 30.

A shaped charge 47 is provided on supply tube 42 whereby the tube can be severed from tool 36 after completion of cementing. Supply tube 42 is connected to a supply of cement and valves 46 are provided to control pressure and flow of fluids eg cement. Tube 42 communicates with perforating gun 40 in order to be able to supply cement thereto during the cementing.

An umbilical connection 50 is provided to a nearby located diving support vessel. The umbilical carries various hydraulic control lines including lines 52 for control of valves 46, line 54 for the control of shaped charge 47, line 56 for control of packer 38 and line 58 for control of gun 40.

As drawn, the packer is set and seals across the bore 30 against the casing 12. There is thus formed a chamber 60 defined by the cement plug 32, the casing 12 and the packer/gun tool 36 and supply tube 42.

Figure 4:
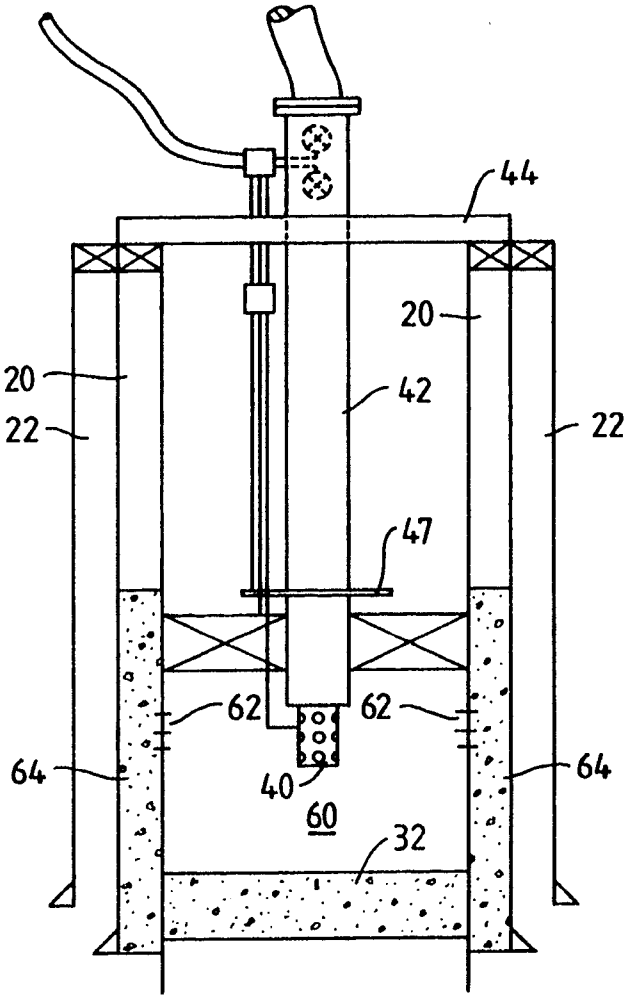
FIG. 4 shows the well after perforation and cementing.

FIG. 4 is the arrangement of FIG. 3 after the perforating gun has been activated to cause perforations 62 in inner casing 12, through which cement 64 has been pumped into annulus 20.

Figure 5:
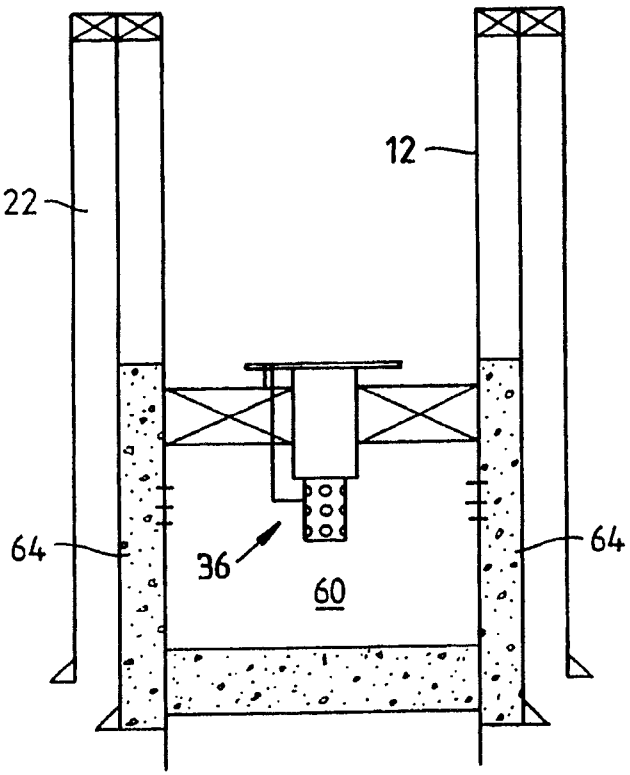
FIG. 5 shows the well after severance and removal of tool.

FIG. 5 shows the well of FIG. 4 after the shaped charge 47 has been fired to sever supply tube 42 from tool 36, the severed supply tube (and control lines) being removed from the well bore.

Figure 6:
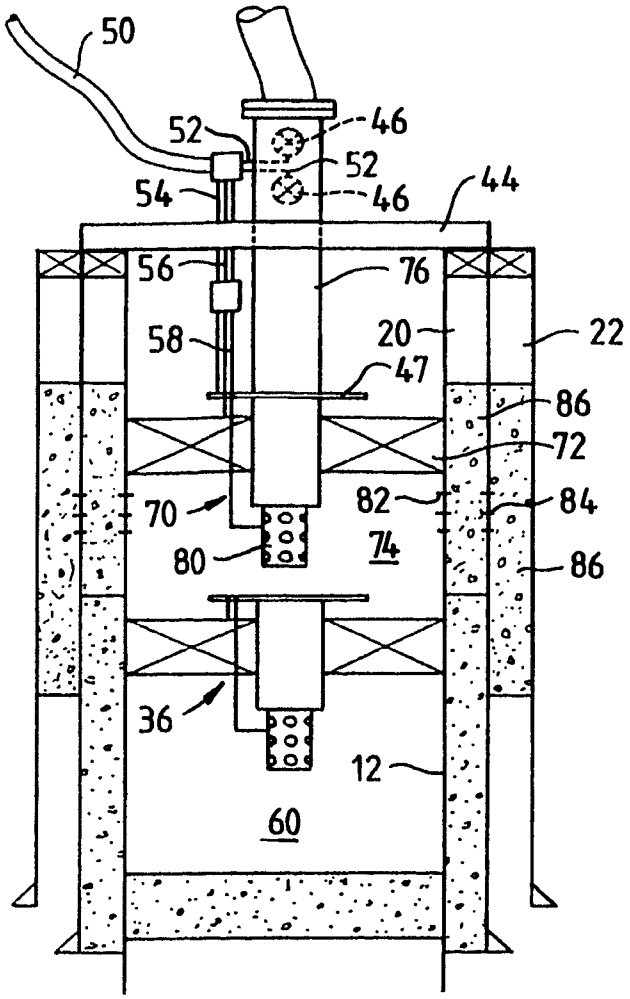
FIG. 6 shows the well after perforation and cementing of a second annulus.

FIG. 6 shows the well of FIG. 5 after a second run. Another packer/gun tool 70 has been run into bore 30 and the packer 72 thereof has been set to seal against the casing 12. There is thus formed a chamber 74 between the casing 12 and the tools 36 and 70. Tool 70 is mounted on supply tube 76 which is arranged similarly to supply tube 42 (FIG. 3). Thus, there are provided umbilical 50, control lines 52,54,46 and 58, valves 46 and shaped charge 47.

Tool 70 includes perforating gun 80 which forms perforations 82 in inner casing 12 and perforations 84 in casing 14. (In the alternative, the inner casing 12 can be severed and then the casing 14 perforated through the cut in casing 12.) The perforations permit cement 86 to be pumped into the respective annuli 20 and 22.

Figure 7:
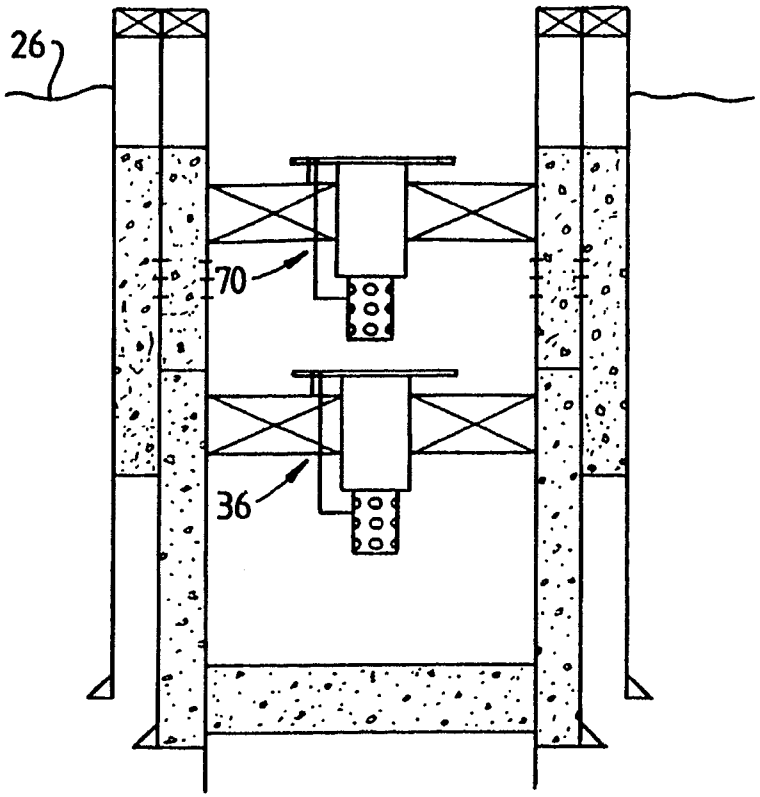
FIG. 7 shows the well of FIG. 6 after removal of the tool.

FIG. 7 shows the well of FIG. 6 after firing of shaped charge 47 and removal of supply tube 76 and control lines from the well.

Figure 8:
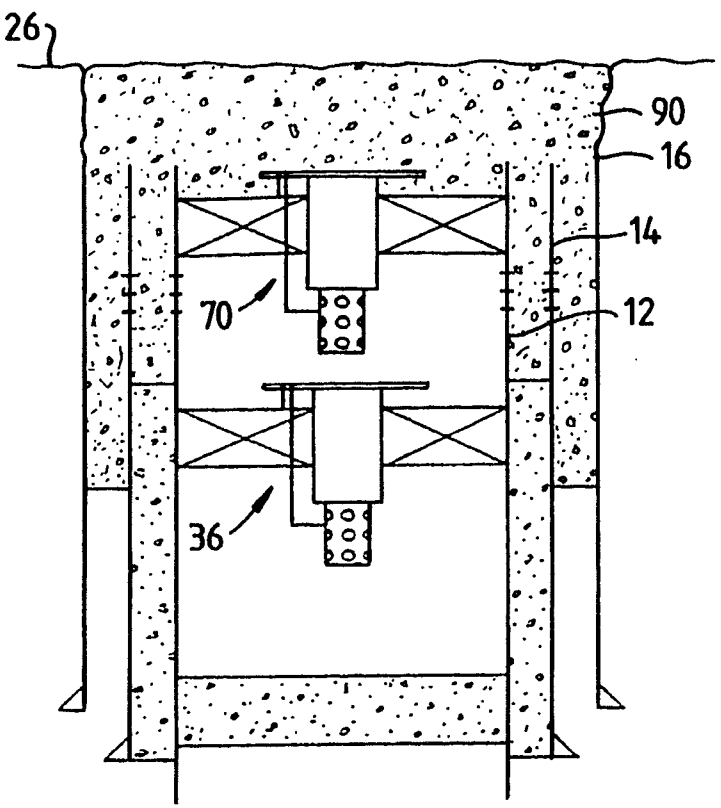
FIG. 8 shows the finished well.

FIG. 8 illustrates the well of FIG. 7 after cutting of the casings 12,14,16 about 15 feet below the mud line 26 and removal of the well head. The top of the well is infilled with cement 90.

Figure 1:
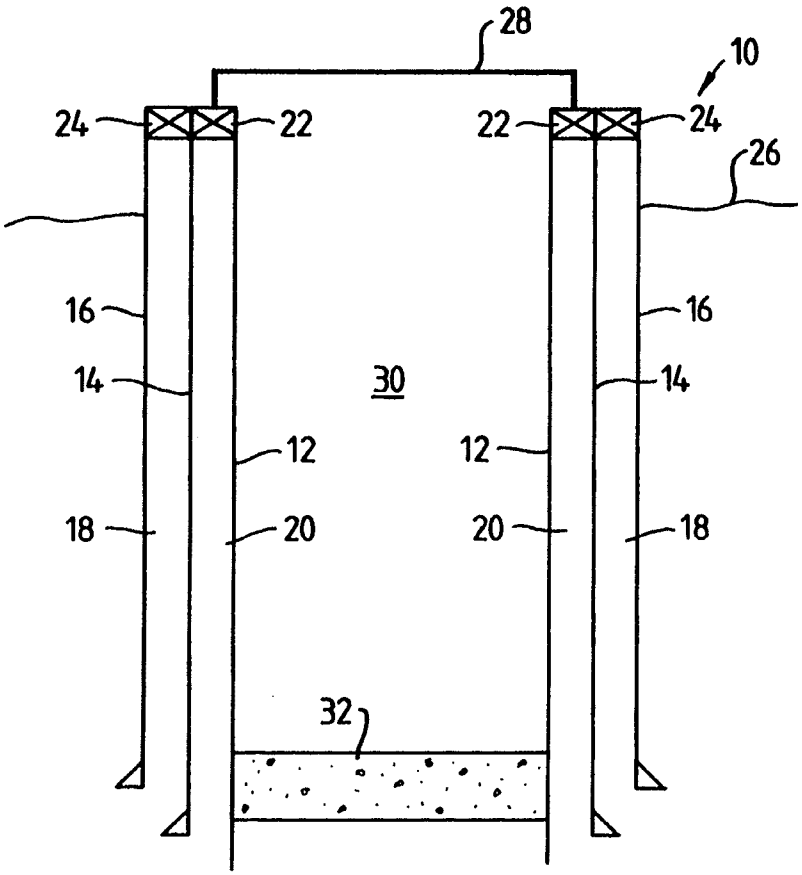
FIG. 1 shows a temporarily abandoned well.

The operation of the preferred embodiment of the invention as illustrated is as follows. FIG. 1 shows the temporarily abandoned well. In the method of the invention, a DSV (diver support vessel) is brought overhead. The corrosion cap 28 is removed and cleaning tool 34 is run into the well (FIG. 2) to thoroughly clean the inner wall of casing 12 so that subsequently the packer(s) will set properly. Next (FIG. 3), the packer/gun tool is run into the well on supply tube 42 and the packer is set hydraulically. The gun 40 is then fired to perforate (FIG. 4) the inner casing 12 (only).

Cement 64 is then pumped through supply tube 42 and through gun 40 and chamber 60 to pass through perforations 62 into annulus 20. The cement fills this region of the annulus 20 to form a seal against escape of any formation fluids therefrom from below. Following cementing, and after pressure testing to ensure a good seal, charge 46 is detonated to sever supply tube 42 from tool 36 (FIG. 5). The tube is withdrawn from the bore leaving the tool 36 permanently in place in the bore. Chamber 60 will normally contain some cement.

When the well has two or more annuli (20, 22) to be sealed, each is usually sealed it, a separate operation. Thus, FIG. 6 illustrates a second run, identical to the first run already described, in which a second packer/gun tool 70 is run into the well and set, perforation is effected, and cementing completed. Cement 86 enters both the first annulus 20 and the second annulus 22 thus effectively sealing particularly annulus 22.

FIG. 7 illustrates the position after firing of shaped charge 47 (FIG. 6) to release supply tube 76 which is then withdrawn from the well.

FIG. 8 illustrates the fully abandoned well. The wellhead has been removed by cutting the casings 12,14,16 below the mudline 26, and then the top of the well has been filled with cement 90.

It will be appreciated that the drawings not only illustrate preferred embodiments of the method of the invention but also of the system of the invention.

What we claim is:

1. A method of securing a suspended cased sub-sea well for abandonment carried out from a non-drilling support vessel having supply tubing, which comprises setting a tubing conveyed packer in the casing in the well, the packer having a perforating gun suspended therefrom; firing the gun to perforate the casing; and pumping cement through the perforations into the annulus behind the casing.

2. A method according to claim 1 which includes the further step of severing the casing above the set packer but below the mud line and removing it from the well.

3. A method according to claim 1, wherein the packer is tubing conveyed, and wherein the tubing is released from the set packer by use of a shaped charge.

4. A method according to claim 1, wherein the packer is set hydraulically.

5. A method according to claim 1, wherein the well includes at least three concentric casings defining annuli therebetween and wherein the inner casing is first perforated and cemented, and thereafter a second tubing conveyed packer is set in the casing above the first packer, with a suspended perforating gun, the second casing is perforated, and the annulus behind the second casing is then cemented; whereafter the tubing is released from the second set packer and removed from the well.

6. A method according to claim 1, wherein after pumping cement into the annulus behind the casing, the casing is severed above the set packer and below the mud line and removed from the well, whereafter cement is pumped into the top of the well.

7. A method according to claim 1 wherein the well to be secured has a corrosion cap thereon and wherein said cap is removed to enable the packer to be introduced into the well.

8. A method according to claim 1, wherein after the cement pumped into the annulus behind the casing has set, the well is pressure tested.

9. A method according to claim 1 wherein the casing of the well is cleaned before the packer is set.

10. A system for securing a sub-sea well having a wellhead for abandonment which comprises a diving support vessel having supply tubing, a tubing conveyed packer and perforating gun for location downhole, cement supply means, and means for severing the casing below the mudline and removal of the wellhead from the well.

* * * * *